US006006693A

United States Patent [19]

Burkett

[11] Patent Number: 6,006,693

[45] Date of Patent: Dec. 28, 1999

[54] BOOKMARK WITH HIGHLIGHTER PEN

[76] Inventor: Mark A. Burkett, 1503 Cherrywood Dr., Martinez, Calif. 94553

[21] Appl. No.: 09/013,869

[22] Filed: Jan. 27, 1998

[51] Int. Cl.[6] ..... B42D 9/00; B43K 9/00

[52] U.S. Cl. ..... 116/234; 401/131; 401/195; 401/202

[58] Field of Search ..... 116/234, 235; 215/228, 295; 401/202, 195, 131; 281/30, 42

[56] References Cited

U.S. PATENT DOCUMENTS

| | | | |
|---|---|---|---|
| D. 300,331 | 3/1989 | Horntrich | D19/43 |
| 2,300,216 | 10/1942 | Grodsky et al. | 116/237 |
| 3,030,922 | 4/1962 | Rosenthal . | |
| 4,162,800 | 7/1979 | Gonot, Jr. et al. | 281/42 |
| 4,934,304 | 6/1990 | Rosen | 116/237 |
| 5,016,559 | 5/1991 | Larson et al. | 116/234 |
| 5,501,171 | 3/1996 | Leake | 116/234 |
| 5,829,903 | 11/1998 | Collins | 401/131 |

FOREIGN PATENT DOCUMENTS

| | | | |
|---|---|---|---|
| 2262070 | 6/1993 | United Kingdom | 401/131 |

*Primary Examiner*—Hezron Williams
*Assistant Examiner*—Willie Morris Worth
*Attorney, Agent, or Firm*—Thomas I. Freiburger

[57] ABSTRACT

A bookmark device formed of plastic has a narrow, low-profile and elongated bookmark extension, with an enlarged, wider cap portion at its upper end. The cap portion provides a cap for a removable highlighter pen which comprises an enlarged head of the bookmark device with an internal reservoir holding highlighter fluid and a highlighter tip for marking text. In a preferred embodiment the cap and the highlighter head lie essentially entirely to one side of the plane of the bookmark extension, so that in use, the bookmark can always be oriented one way or the other between the pages of the book without increasing the profile of the book. In one embodiment the bookmark device can be part of a set of components including additional highlighter heads, for replacement purposes and for providing different highlighter colors. The device is conveniently used for highlighting while reading.

9 Claims, 3 Drawing Sheets

BOOKMARK WITH HIGHLIGHTER PEN

BACKGROUND OF THE INVENTION

This invention is directed to a bookmark device, and particularly one in which the bookmark is combined with a highlighter pen.

Various combinations of bookmarks with other purposes have been known. Examples are shown in the following patents: Des. 190,556 (Heathman), Des. 317,175 (Dickson), Des. 322,811 (Isern), Des. 355,933 (Collins) and U.S. Pat. No. 5,095,846 (Knight). The design patents of Isern and Collins show bookmarks combined with felt-tipped markers, i.e., highlighter pens. The Dickson and Knight patents show bookmarks having some means for gripping a writing instrument. However, none of these prior patents shows a combined bookmark and highlighter pen having the advantageous construction, features and convenience of use of the present invention described below.

SUMMARY OF THE INVENTION

The invention described herein is a combined bookmark and highlighter pen wherein the bookmark portion is of thin, very low profile, with a larger upper end which extends out from the pages of a book and includes a highlighter for marking pages of the book. The invention avoids the need for a thick-bodied bookmark portion to contain highlighter fluid, as in some prior art, since this would thicken and distort the closed book, be awkward in use and potentially could damage the book's binding. Also, the invention is distinct from a highlighter pen merely connected to a bookmark in such a way that the pen itself hangs outside and behind the spine of the book, as in other prior art, which is also awkward and inconvenient in use and sometimes subject to accidental removal or breakage of the pen, by its position.

Instead, the bookmark and highlighter of the invention includes a highlighter head which is removable from the low-profile bookmark extension and which is positioned very conveniently for gripping, removal from the bookmark extension and use in marking of pages of the book. At the same time, the thickness profile of the book is not increased by the bookmark, but the removable highlighter head merely extends outwardly from the top of the pages of the closed book, between the confines of the front and back cover.

In a preferred embodiment, a combined bookmark and highlighter pen according to the invention includes an elongated bookmark extension of thin, flat, blade-like profile, with an enlarged cap portion at a top end of the bookmark extension, thicker in profile than the bookmark extension but preferably molded as one piece. The bottom of the cap portion forms a ledge protruding out from the bookmark extension in position to engage downwardly against pages of a book to provide a limit position for the bookmark's insertion between the pages of a book. The assembly includes a removable highlighter head, formed as a separate piece from the bookmark extension and cap portion, and having an internal reservoir storing highlighter fluid from the lower end of this head extends a soft highlighter tip in fluid communication with the highlighter fluid. To secure and cap the highlighter, the cap portion of the bookmark has an upwardly facing receptacle sized to tightly receive a surrounding collar of the highlighter tip, forming a bookmark device of unitary appearance.

Thus, the bookmark may be used to mark a page position in the book when the book is closed, and, with the book opened the bookmark extension may be moved to another position between pages of the book and the highlighter head can be easily removed and replaced to use for marking open pages of the book.

In a specific embodiment of the invention the lower end of the highlighter head i.e., the lower end of a body portion just above the tip, is curved so as to push the highlighter head up and out from the cap portion when the head is twisted, thereby requiring only one hand to perform the operation, while the other hand may hold the book.

One important feature in preferred embodiments is that the cap portion and highlighter head are positioned essentially entirely to one side of the plane of the low-profile bookmark extension, so that whatever position the bookmark is placed in the book, it can be oriented to avoid extending outward beyond the front or back cover of the book. In this way the book's thickness profile is not increased when stacked with other books or placed against other flat objects.

The bookmark/highlighter as described can form a part of a set which includes a plurality of replacement highlighter heads, and these can include more than one color of highlighter fluid. Replacement with another head is convenient if a highlighter head's fluid supply is depleted.

In use of the bookmark device of the invention, the bookmark retains a profile within that of the thickness of the book when the book is closed. When the book is opened to a page of interest, the bookmark can be moved to a rearward or forward position between pages of the book, away from the page of interest. With the book thus holding the bookmark extension firmly in position, the user can remove the highlighter head and can conveniently use the highlighter to mark areas of interest. The highlighter head is easily replaced in the cap formed at the upper end of the bookmark extension, and the resulting unitary device is easily manipulated, stored or moved from book to book. Use of the device is so convenient that the user can keep his eyes on the book pages while removing the highlighter head with one hand and while later replacing the head. The bookmark extension, held between other pages of the book, is firmly held while the cap is removed and replaced.

It is therefore a primary object of the invention to make easier and more convenient the use of a highlighter-type marker in reviewing a book or booklet, while also providing an easily used, low-profile bookmark. These and other objects, advantages and features of the invention will be apparent from the following description of preferred embodiments, considered along with the accompanying drawings.

DESCRIPTION OF THE PREFERRED EMBODIMENTS

Figure 1:
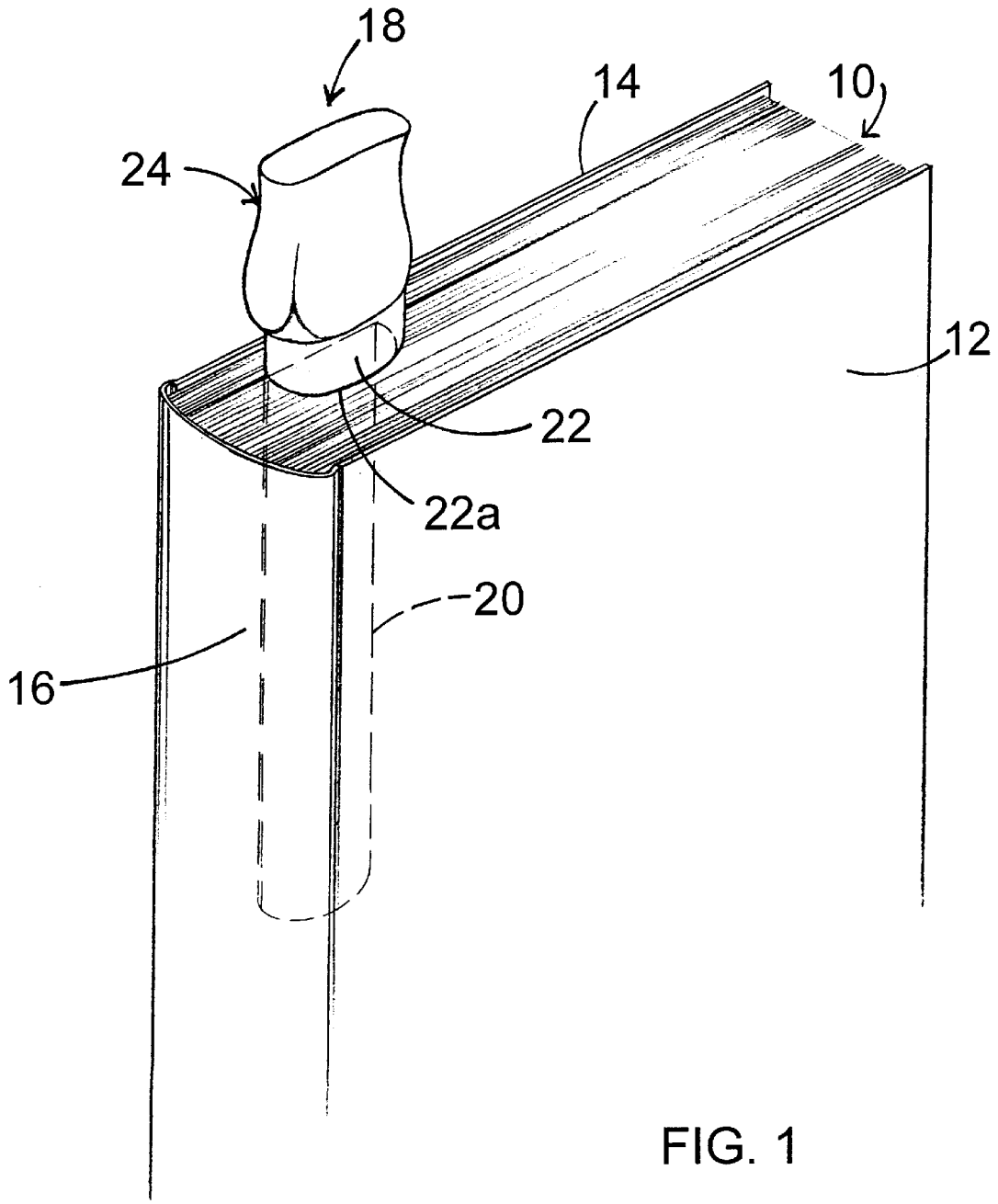
FIG. 1 is a perspective view showing a book whose pages are marked by the combined bookmark and highlighter pen of the invention.

FIG. 1 shows a book 10, in this case a bound book with front and back covers 12 and 14 and a spine 16 at the title-bearing edge of the binding, connected to the covers, with a bookmark device 18 holding a position between pages of the book. The bookmark device could also be used in a booklet, magazine or large stack of papers to mark a place.

The bookmark device 18 includes a thin, flat, low-profile bookmark extension 20, an enlarged cap portion 22 secured to and preferably integrally formed with the portion 20, and a separate highlighter head 24 which is tightly received in the cap portion 22 but removable therefrom. As FIG. 1 clearly shows, the lower side 22*a* of the cap portion 22 provides a sharp ledge to define a definite limiting position for insertion of the bookmark device into the book, and holds the bookmark in place against slipping down.

Figure 2:
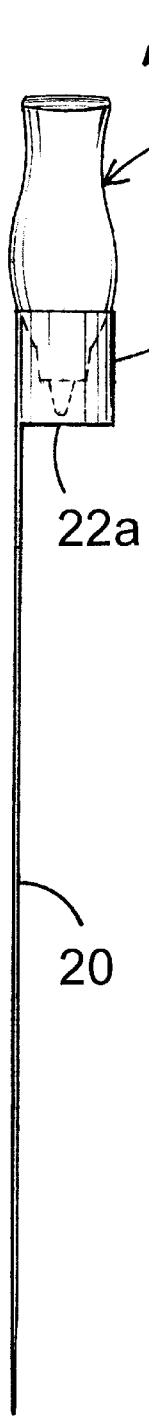
FIG. 2 is a side elevation view of the bookmark device.
Figure 3:
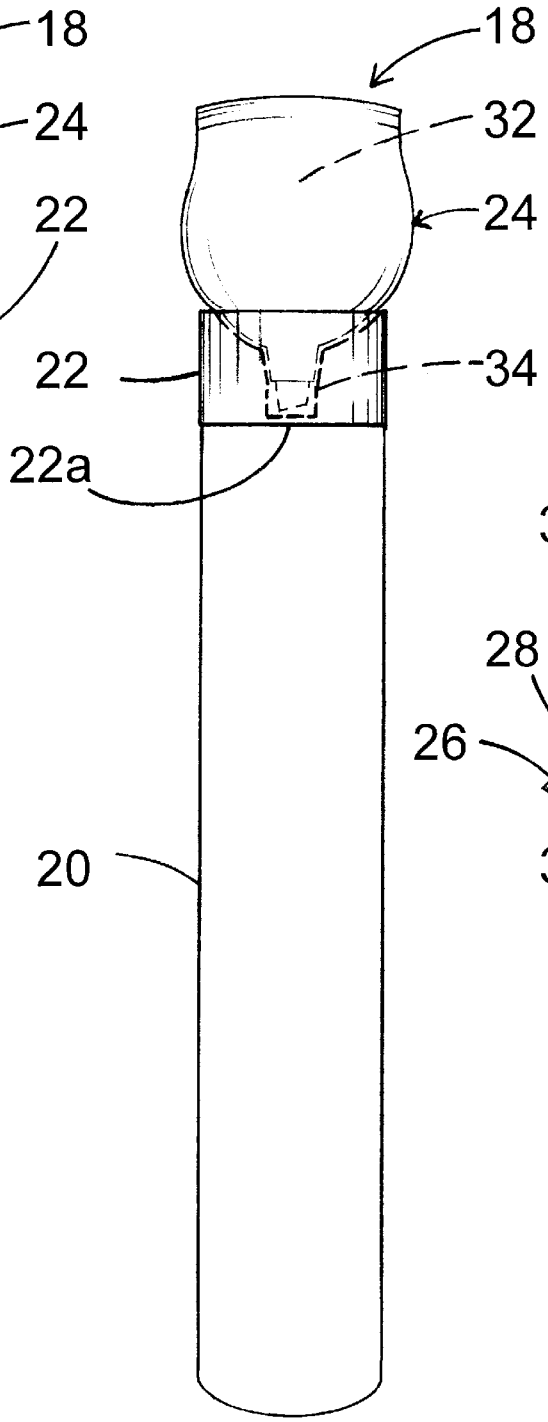
FIG. 3 is a front elevation view of the bookmark device.
Figure 4:
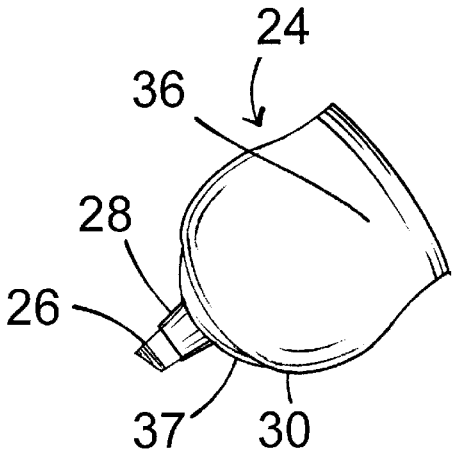
FIG. 4 is a view showing the highlighter head removed from the remainder of the bookmark device, for use in marking text.

FIGS. 2 and 3 show the bookmark device 18 in side and frontal views, with the highlighter head 24 retained in the cap portion 22. FIG. 4 shows the highlighter head as removed from the bookmark portion (i.e. the bookmark extension 20 and cap 22), for use in highlighting pages. As these drawings indicate, the highlighter head includes a highlighter tip 26 of the usual soft, wicking material, supported by a highlighter collar 28 which is rigidly secured to or integral with the body portion 30 of the highlighter head. The soft highlighter tip 26 extends into or is in fluid communication with an internal liquid reservoir 32 of the highlighter head, shown in dashed lines in FIG. 3. The highlighter device is constructed in a manner similar to highlighters in common use, although the shape of the highlighter 24 is unconventional.

FIGS. 2 and 3 also show that the highlighter head 24 is securely received, tip down, in the cap portion 22 secured to the bookmark extension 20. The cap portion 22 includes an internal cavity 34, which may be cylindrical and which is shown in dashed lines in FIG. 3, sized to closely grip the external surface of the highlighter collar 28. For this purpose, the collar 28 may be slightly tapered toward a smaller dimension toward the tip, and the cap's cavity 34 may be similarly tapered, or both, to achieve a tight and sealing fit.

FIG. 2 shows that essentially all of the bulk of the highlighter head 24 and cap portion 22, in profile, lie to one side of the plane of the thin, flat bookmark extension 20. A very small portion of the head's profile may extend to the other side, as shown in FIG. 2, still allowing the entire bookmark to be within the profile of the closed book even when it is placed near the extreme front or back of the book.

FIG. 4 shows that the highlighter head 24 may have concave side surfaces, one of which 36 is shown in the figure. These provide convenient, comfortable gripping surfaces for holding the highlighter device between the thumb and forefinger in use.

As shown particularly in FIGS. 3 and 4, the highlighter head's body portion 30 in a preferred embodiment is rounded or curved at a bottom end 37. The cap portion 22 has a shape which is either generally rectangular or oval as seen particularly in FIG. 1. Thus, assistance is provided in removal of the highlighter head by twisting of the head 24, which in a camming action forces the highlighter head upwardly and outwardly to help free the highlighter collar 28 from the cap's cavity 34.

Figure 5:
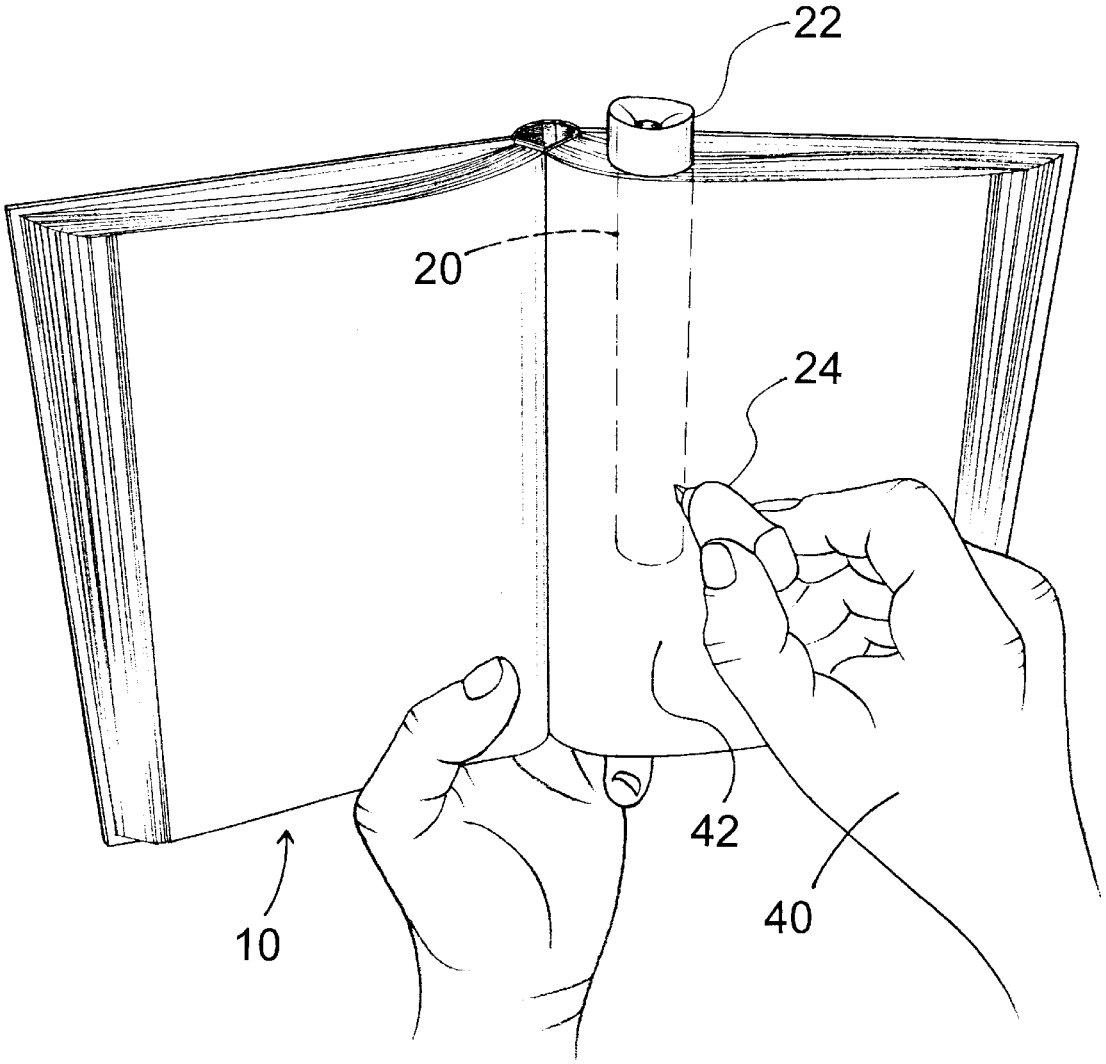
FIG. 5 is a perspective view showing the bookmark/highlighter device in use.

FIG. 5 illustrates a convenient manner of use of the bookmark/highlighter pen of the invention. In FIG. 5 the bookmark portion is shown moved to the back of the book 10, near the back cover, which firmly holds the bookmark extension and cap 22 in place. The user has removed the highlighter head 24, which may in a preferred embodiment be accomplished by twisting the head as explained above. The highlighter is thus held by the user 40, ready for marking areas of interest on an open page 42 of the book. If the page of interest were near the end of the book, the user would simply place the bookmark device between pages closer to the front of the book.

When the user has finished use of the highlighter, he or she replaces the highlighter head 24 into the cap portion 22, moves the bookmark device 18 to a position needed for further reference at a later time, and closes the book. As outlined above, if the marked position is near the front of the book, the bookmark device will be turned opposite the position shown in FIG. 1, so that the highlighter head 24 and cap portion 22 are in a position extending rearward from the plane of the bookmark extension 20. This keeps the entire bookmark device within the thickness profile of the book 10.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A combined bookmark and highlighter pen device, comprising:

an elongated bookmark extension of thin, flat, blade-like profile, an enlarged cap portion at a top end of the bookmark extension, thicker in profile than the bookmark extension and with a bottom of the cap portion forming a ledge protruding out from the bookmark extension in position to engage downwardly against pages of a book to provide a limit position for insertion of the bookmark between the pages of a book, a highlighter head, formed as a separate piece from the bookmark extension and cap portion, the highlighter head having an internal reservoir storing highlighter fluid and having a lower end with a soft highlighter tip in fluid communication with the highlighter fluid, and the cap portion of the bookmark extension having an upwardly facing receptacle sized to tightly receive the lower end of the highlighter head and to cover the highlighter tip, thus joining the highlighter head with the cap portion to form a bookmark device of unitary and generally straight appearance, whereby the bookmark may be used to mark a page position in the book when the book is closed, and, with the book opened the bookmark extension may be moved to another position between pages of the book and the highlighter head can be removed to use for marking open pages of the book.

2. The device of claim 1, wherein the cap portion and the highlighter head are positioned essentially to one side of a plane within which the bookmark extension lies.

3. The device of claim 1, wherein the lower end of the highlighter head is curved upwardly at left and right of the highlighter tip, so that twisting of the highlighter head relative to the cap portion and bookmark extension will force the highlighter head upward and out from the cap portion, assisting in removal.

4. The device of claim 1, wherein the highlighter head has concave walls for gripping between a thumb and forefinger of a user, for comfortable gripping of the highlighter head during use.

5. A combined bookmark and highlighter pen device, comprising:

an elongated bookmark extension of thin, flat, blade-like profile, an enlarged cap portion at a top end of the bookmark extension, thicker in profile than the bookmark extension and with a bottom of the cap portion forming a ledge protruding out from the bookmark extension in position to engage downwardly against pages of a book to provide a limit position for insertion of the bookmark between the pages of a book, a highlighter head, formed as a separate piece from the bookmark extension and cap portion, the highlighter head having an internal reservoir storing highlighter fluid and having a lower end with a soft highlighter tip in fluid communication with the highlighter fluid, and the cap portion of the bookmark extension having an upwardly facing receptacle sized to tightly receive the lower end of the highlighter head and to cover the highlighter tip, thus joining the highlighter head with the cap portion to form a bookmark device of unitary appearance, and a plurality of additional said highlighter heads adapted to fit into the receptacle of the bookmark extension to serve as replacement highlighter heads, thus extending useful life of the combined bookmark and highlighter pen device, whereby the bookmark may be used to mark a page position in the book when the book is closed, and, with the book opened the bookmark extension may be moved to another position between pages of the book and the highlighter head can be removed and used for marking open pages of the book.

6. The set of components of claim 5, including additional highlighter heads with different colors of highlighter fluid.

7. The set of components of claim 1, wherein the bookmark extension and the enlarged cap portion comprise a single integrally molded component.

8. A method for use of a combination bookmark and highlighter pen, comprising:

providing a combined bookmark and highlighter pen device including a bookmark extension of thin, flat, blade-like profile, with an enlarged cap portion at a top end of the bookmark extension, thicker in profile than the bookmark extension and formed as a single unit with the bookmark extension, and including a highlighter head formed as a separate piece and having an internal reservoir storing highlighter fluid and having a soft highlighter tip at a lower end, in fluid communication with the highlighter fluid, and the cap portion of the bookmark extension having an upwardly facing receptacle to tightly receive the lower end of the highlighter head and to cover the highlighter tip, thus joining the highlighter head with the cap portion to form a bookmark device of unitary appearance, placing the bookmark device in a book to mark a page of interest, by placing the bookmark extension between pages with the enlarged cap portion and highlighter head extending up from the pages, later, opening the book to the page of interest, and moving the bookmark device to another location in the book, with the bookmark extension positioned firmly between pages of the book, removing the highlighter head from the cap portion of the bookmark device, and using the highlighter head to mark a page of interest at which the book is opened while leaving the bookmark extension held between pages at another location in the book.

9. The method of claim 8, wherein the lower end of the highlighter head is curved upwardly at left and right of the highlighter tip, and wherein the step of removing the highlighter head comprises maintaining the reader's eyes on the page of interest while gripping and rotating the highlighter head with one hand to twist the highlighter head relative to the cap portion and thus to force the highlighter head upward and out from the cap portion to enable its use.

* * * * *